US006000937A

United States Patent [19]

Schilling et al.

[11] Patent Number: 6,000,937

[45] Date of Patent: Dec. 14, 1999

[54] DEVICE FOR DISTRIBUTING AND/OR FEEDING A HOT FLOUR-LIKE MATERIAL

[75] Inventors: Horst Schilling; Hans Günter Müller, both of Cologne, Germany

[73] Assignee: KHD Humboldt Wedag AG, Cologne, Germany

[21] Appl. No.: 09/075,611

[22] Filed: May 11, 1998

[30] Foreign Application Priority Data

May 17, 1997 [DE] Germany ..... 197 20 951
Jul. 30, 1997 [DE] Germany ..... 197 32 778

[51] Int. Cl.[6] ..... F27B 7/02

[52] U.S. Cl. ..... 432/106

[58] Field of Search ..... 432/14, 16, 58, 432/106, 77, 78

[56] References Cited

U.S. PATENT DOCUMENTS 4,388,067 6/1983 Christiansen ..... 432/106
4,570,549 2/1986 Trozzi ..... 110/106
4,817,442 4/1989 Loosemore ..... 73/863.56
5,349,910 9/1994 Hundebol ..... 432/106

FOREIGN PATENT DOCUMENTS 0222 044 5/1987 European Pat. Off. .

*Primary Examiner*—Mark Paschall
*Assistant Examiner*—Gregory A. Wilson
*Attorney, Agent, or Firm*—Nexsen Pruet Jacobs & Pollard, LLP; Charles L. Schwab, Esq.

[57] ABSTRACT

A cement plant for the production of cement clinker from cement raw meal has a flat plate shaped control element for distributing and/or transporting-feeding a stream of hot flour-like material which is subjected to severe thermo-chemical and abrasive ware. the service life of the control element is greatly increased by constructing it as a hollow body (19, 22) through which coolant flows from at least one inlet opening to at least one discharge opening.

13 Claims, 3 Drawing Sheets

DEVICE FOR DISTRIBUTING AND/OR FEEDING A HOT FLOUR-LIKE MATERIAL

TECHNICAL FIELD

This invention relates to a device for distributing and/or feeding a hot flour-like material, in particular a stream of hot cement raw meal, in an installation for the production of cement clinker from cement raw meal, which is preheated in a heat-exchanger system and burned to cement clinker in a cylindrical rotary kiln.

BACKGROUND OF THE INVENTION

In installations for the production of cement clinker from raw meal, which is preheated and calcined before the burning operation, it is often necessary to divide a stream of hot cement raw meal into two meal discharges, that is, to convey hot raw meal into one and/or another meal discharge. Thus, for example, in the installation for the production of cement clinker from cement raw meal as shown in European patent document EP-B 0222 044 published Mar. 8, 1989, the preheated raw meal exiting downward from the next-to-last (second-lowest) cyclone stage must be divided in a controlled way into a calcination zone lying in the clinker-cooler off-gas line (tertiary air line), on the one hand, and a calcination zone lying in the rotary-kiln off-gas line, on the other. What is more, in certain dual-train installations (twin installations) where the cement raw meal of one train, precalcined in the rotary-kiln off-gas line, undergoes final calcination in the calcination zone of the other train, operated on hot clinker-cooler off-gas, after the installation has been started up, precalcined cement raw meal exiting from the lowest cyclone stage of the rotary-kiln off-gas train must be admitted by means of a changeover flap not to the rotary kiln but to the secondary calcination zone of the other train, which is ready for operation.

The distribution or changeover of the stream of hot raw meal has heretofore been effected with a distributor housing, to the top of which the hot meal delivery line can be connected and to the bottom of which two hot meal discharges can be connected, so that the distributor housing is also called a "breeches pipe" because of its shape. In the breeches pipe, a flap is pivotably arranged, by means of the pivot actuation of which flap the stream of hot cement raw meal, which can exhibit a temperature of, for example, 800 to 900° C., is distributed or changed over. The pivotable flap in particular is obviously subjected to severe thermochemical and abrasive wear.

Also subjected to severe wear are "impingement gates," which in cement plants are built transversely into a hot-gas line coming from the rotary kiln and/or from the clinker cooler and have the task of uniformly distributing or suspending, over the hot-gas cross section, preheated cement raw meal, which is introduced into the hot-gas line from the side.

What is more, in cyclone suspension-type preheater trains having cyclones arranged one above another through which hot gas flows in order to heat cement raw meal, "flap boxes" or "oscillating feeders" and also double oscillating feeders are built into the meal downpipes, in which boxes one or two weighted oscillating flaps are integrated, which have the task of holding back the stream of hot gas on the one hand, and on the other hand, by means of pivoting of the flaps, of allowing the stream of hot raw meal to pass downward through the meal downpipe after a certain solids burden. These oscillating flaps are also subjected to severe wear.

OBJECTS AND SUMMARY OF THE INVENTION

It is an object of the invention to create, especially for cement plant engineering, a device for distributing and/or feeding a hot stream of flour-like material, of which device the internal control elements are subjected to severe wear, in particular the actuator, have a long service life.

In this invention the device for distributing and/or transporting-feeding a stream of hot flour-like material, has a pivoting flap/oscillating flap or impingement gate, which is especially subject to wear, is made as a hollow plate-shaped body through which coolant flows, by way of at least one coolant inlet opening and at least one coolant discharge opening. For the sake of simplicity, outdoor air is used as cooling air, which is forced through the plate-shaped hollow body by a cooling-air fan or by a connection to the compressed-air system. The coolant cools the metallic hollow flap or hollow impingement gate, including the surface thereof. Solid buildups on the cooled, comparatively lightweight elements according to the invention are avoided. On the whole, the lifetime or service life of the hot-meal distributor device or hot-meal feeder is very long.

BRIEF DESCRIPTION OF THE DRAWINGS

The invention and its further features and advantages are explained in more detail on the basis of exemplary embodiments illustrated schematically in the Drawing in which.

DETAILED DESCRIPTION OF THE INVENTION

Figure 6:
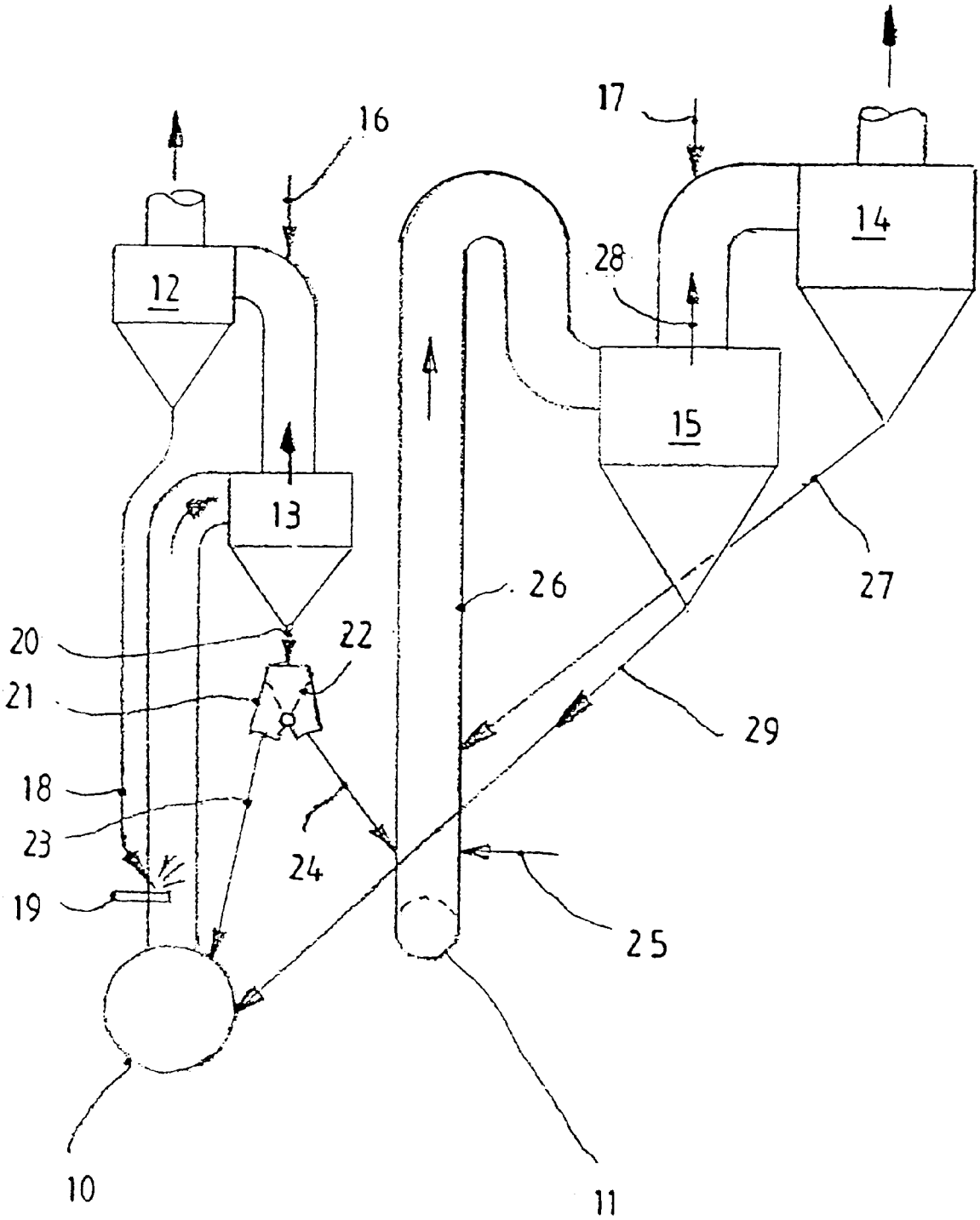
FIG. 6 shows in schematic detail a "dual-train" installation (twin installation) for the production of cement clinker from cement raw meal, which has an integrated air-cooled hot-meal changeover flap and an integrated air-cooled impingement gate.

The dual-train installation for the production of cement clinker from cement raw meal, shown in FIG. 6, has a left train, through which off-gas from a rotary kiln 10 flows, and a right train, which is supplied with high-temperature cooler off-gas from hot cooler off-gas via a tertiary air line 11 of the clinker cooler, not shown. Each of the two trains has cyclone suspension-type preheater trains operated separately, of each of which, for the sake of simplicity, only the two lowest cyclone stages 12, 13 and 14, 15 are shown. Of the entire quantity of raw meal processed in the dual-train installation, approximately 50% of the raw meal, for example, can be admitted to the left train at 16, and similarly approximately 50% of the raw-meal quantity, for example, can be admitted to the right train at 17. The hot raw meal from the second-lowest cyclone stage 12 of the left train, at roughly 800° C., is introduced into the hot rotary-kiln off-gas line, at roughly 900 to 1100° C., via line 18, and there precalcined with or without the addition of fuel. The point of raw-meal inlet to the rotary-kiln off-gas line is located above an impingement gate 19, which has the purpose of uniformly distributing the inlet hot raw meal over the cross section of the rotary-kiln off-gas.

When the installation of FIG. 6 is started up, no hot cooler off-gas from the clinker cooler is available to operate the right train. At this stage, the hot meal 20, at roughly 800 to 900° C., separated from the rotary-kiln off-gas in the lowest cyclone stage 13 of the left train, is admitted directly to the inlet chamber of the rotary kiln 10 by apportioning box 21, whose oscillating flap 22 has taken up the right pivoted position, via the material discharge pipe 23. After startup operation has come to an end, when sufficiently hot cooler off-gas is available via the tertiary air line 11, the flap 22 of the changeover box 21 is changed over and the hot meal of the left train is inlet via hot-meal line 24 to the calciner 26 in the clinker cooler off-gas line 11 of the right train, which is fitted with secondary firing 25, into which calciner the raw meal from the second-lowest cyclone stage 14 of the right train is also inlet via line 27. Finally, all the cement raw meal calcined in the calciner 26 is separated from the hot off-gas stream 28 in the lowest cyclone 15 of the right train and inlet, as highly (for example, 95%) calcined cement raw meal 29, to the rotary kiln 10, in the sintering zone of which it is burned to cement clinker.

Figure 1:
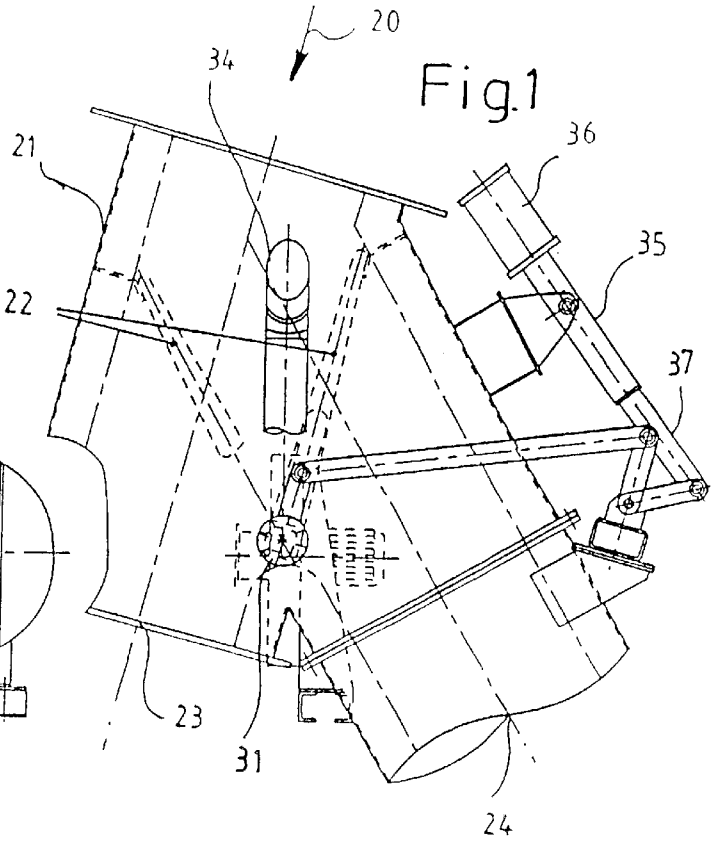
FIG. 1 shows, in side view, a breeches-pipe-shaped hot-meal distributor housing having an air-cooled adjustable flap for the distribution/changeover of a stream of hot meal arriving from above into one and/or another discharge, viewed in the direction of the arrow I of FIG. 2.
Figure 2:
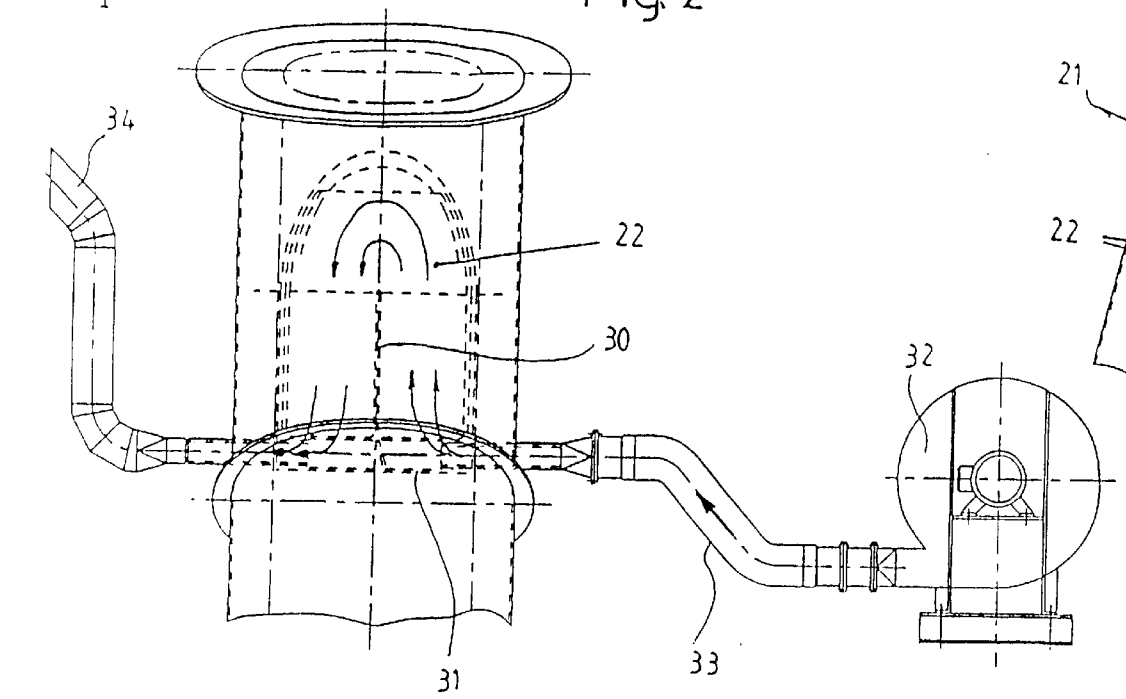
FIG. 2 shows another side view, offset 90° from FIG. 1, of the hot-meal changeover box of FIG. 1, having an integrated air-cooled changeover flap with parts omitted for illustration purposes.

The hot-meal apportioning box or distributor box 21, having the cooled control flap 22, is detailed in FIGS. 1 and 2. The flap 22, pivotable about its bottom end, is made as a hollow body through which coolant flows, which hollow body is arranged in the breeches-pipe-shaped housing 21 and, depending on the pivoted position, discharges the inlet hot-meal stream 20 into one and/or the other material discharge 23, 24. As shown in FIG. 2, at least one web 30, arranged transversely to the flap plane, is built into the interior of the hollow flap 22, which web diverts the coolant, cooling air in the exemplary embodiment, admitted via one end of the hollow flap shaft 31, through the cavity in the flap to the other end of the hollow flap shaft 31 for the purpose of prolonging the residence time of the coolant. The cooling air delivered by the cooling-air fan 32 is introduced via a flexible line 33 into one end of the hollow shaft 31, and the cooling air heated in the flap 22 is discharged to the surroundings via the other end of the hollow shaft 31 via line 34. The pivoting flap 22 is actuated via an actuator 35, for example an electrical actuator having motor 36 and articulated spindle 37, or via hydraulic pivoting cylinder, pneumatic pivoting cylinder, etc. In any case, the cooled flap 22 of the hot-meal distributing device according to the invention, which is subjected to severe thermochemical and abrasive wear, is distinguished by a long service life.

An oscillating flap of an oscillating feeder or hot-meal downpipe, through which coolant flows, can be made similarly to the pivoting flap 22 of FIGS. 1 and 2, through which coolant flows.

Figure 4:
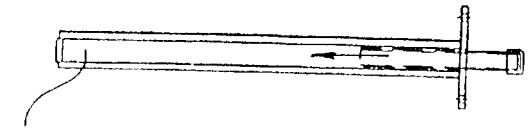
FIG. 4 shows a somewhat enlarged detail of the vertical section through the air-cooled impingement gate of FIG. 3.
Figure 5:
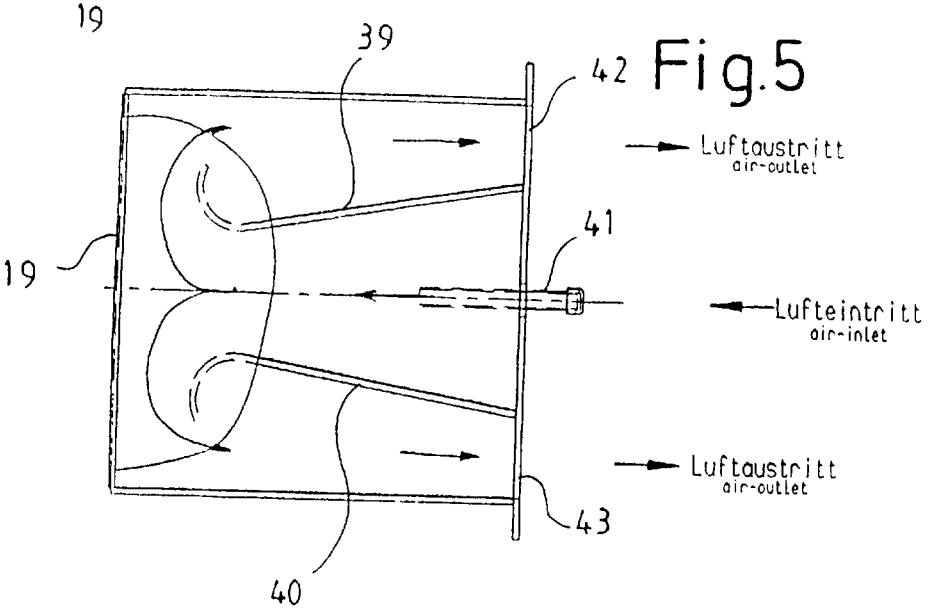
FIG. 5 is a top view, partly in horizontal section, of the air-cooled impingement gate of FIG. 4.
Figure 3:
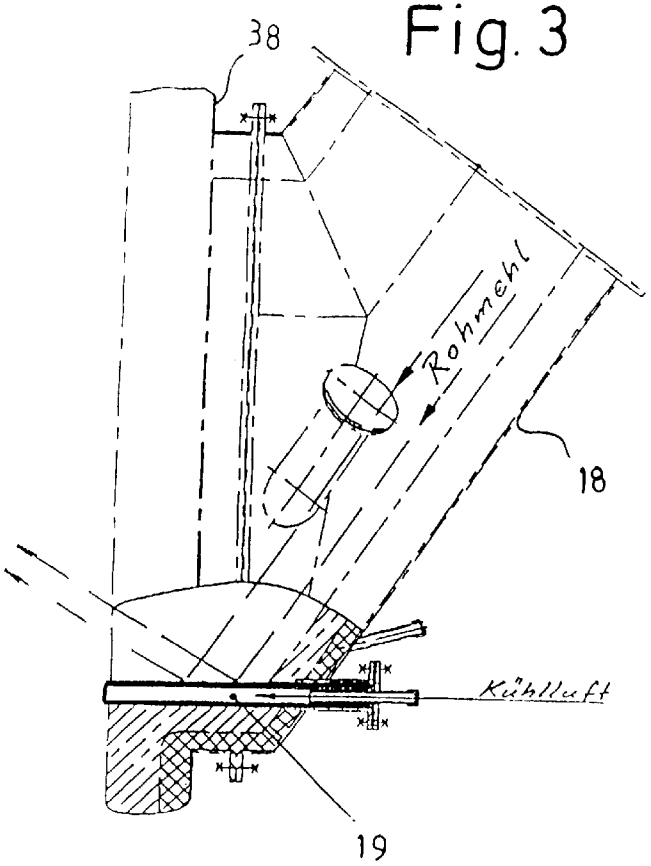
FIG. 3 shows, in vertical section, an air-cooled impingement gate built into a rotary-kiln off-gas riser below the hot-meal inlet opening.

The impingement gate 19 of FIG. 6 is detailed in FIGS. 3 to 5. In distinction to FIG. 6, the impingement gate 19 in FIG. 3 is built into the rotary-kiln off-gas line or riser 38 from the right side. The hot meal introduced via the meal line 18 is, on impinging on the impingement gate 19, uniformly distributed by said impingement gate over the entire cross section of the rotary-kiln off-gas riser. The impingement gate 19 is also made as a hollow body through which coolant flows, in the interior of which hollow body there is built-in at least one web arranged transverse to the gate plane, specifically two webs 39, 40 in the exemplary embodiment of FIG. 5, which webs divert the coolant, again cooling air in the exemplary embodiment, admitted via an inlet opening 41 arranged on the outer end face of the gate, to at least one coolant discharge opening likewise arranged on the outer end face of the gate, according to FIG. 5 to the discharge openings 42 and 43. The cooling air admitted via opening 41 to the hollow impingement gate 19 can be a high-velocity compressed air, which by the injector principle draws further quantities of air located in the vicinity into the hollow body from the surroundings and conveys said quantities of air through the hollow body for its cooling. The service life of the air-cooled impingement gate 19 of FIG. 3 is likewise very long.

The air-cooled impingement gate 19 can be built into not only the calcination zone of the rotary kiln off-gas line or riser 38 of the cement clinker production line, as shown in the example of FIG. 6, but also at another point of the cyclone suspension-type heat-exchanger system, for example in the off-gas line between the lowest and second-lowest cyclone, and so forth.

What is claimed is:

1. In a cement plant for producing cement clinker from cement raw meal by preheating the raw meal in a heat-exchanger system receiving heated gases from a rotary kiln off-gas line and from a clinker cooler off gas line, each of said off-gas lines having a point of entry for raw meal, and burning the preheated raw meal to cement clinker in the rotary kiln, said heat exchanger system comprising:

apparatus for apportioning the flow of raw meal including a housing (21) in the shape of a breeches pipe having a raw material inlet opening (20) at its top and two raw material discharges (23, 24) at its bottom, a hollow flap (22) in said housing and a shaft (31) pivotally supporting said flap in said housing (21), said hollow flap (22) including at least one coolant inlet opening and at least one coolant outlet opening whereby coolant is permitted to flow through said hollow flap (22) and said hollow flap (22) being pivotable to selectively apportion flow of said raw material entering said inlet opening (20) to said material discharges (23, 24) and a hollow impingement gate (19) integrated in one of said off-gas lines below said point of entry for raw meal in said one off-gas line, whereby said raw meal delivered to said one off gas line is distributed by impingement with said hollow gate (19), said hollow impingement gate (19) having a coolant inlet opening (41), at least one coolant discharge opening (42,43), and at least one web (39, 40) within said hollow gate (19) for distributing coolant flow through said hollow gate (19).

2. The cement plant of claim 1 wherein said shaft (31) is hollow and said shaft (31) presents said coolant inlet opening and said coolant discharge opening.

3. The cement plant of claim 1 wherein said hollow flap (22) is plate shaped and includes a web (30) transverse to the plane of said hollow flap (22) operating to divert coolant flowing through said hollow flap (22).

4. The cement plant of claim 1, wherein said cement plant includes an oscillating feeder for raw meal and said hollow flap (22) is a weighted oscillating flap of said oscillating feeder for cement raw meal.

5. The cement plant of claim 1 wherein said one web (39, 40) is disposed transverse to the plane of said gate (19) and diverts the coolant admitted via said coolant inlet opening (41) in route to at least one coolant discharge opening (42, 43).

6. The cement plant of claim 5 wherein at least one of said coolant discharge openings (42, 43) and said coolant inlet opening (41) are located in an end face of said gate (19).

7. In a cement plant for producing cement clinker from cement raw meal by preheating the raw meal in a heat-exchanger system receiving heated gases from a rotary kiln off-gas line and from a clinker cooler off gas line, each of said off-gas lines having a point of entry for raw meal, and burning the preheated raw meal to cement clinker in the rotary kiln, said heat exchanger system comprising:

apparatus for apportioning the flow of raw meal including a housing (21) in the shape of a breeches pipe having a raw material inlet opening (20) at its top and two raw material discharges (23, 24) at its bottom, a hollow flap (22) in said housing and a shaft (31) pivotally supporting said flap in said housing (21), said hollow flap (22) including at least one coolant inlet opening and at least one coolant outlet opening whereby coolant is permitted to flow through said hollow flap (22) and said hollow flap (22) being pivotable to selectively apportion flow of said raw material entering said inlet opening (20) to said material discharges (23, 24).

8. The cement plant of claim 7 wherein said shaft (31) is hollow and said shaft (31) presents said coolant inlet opening and said coolant discharge opening.

9. The cement plant of claim 8 wherein said hollow flap (22) is plate shaped and includes a web (30) transverse to the plane of said hollow flap (22) operating to divert coolant flowing through said hollow flap (22).

10. The cement plant of claim 7 wherein said cement plant includes an oscillating feeder for cement raw meal and said hollow flap (22) is a weighted oscillating flap of said oscillating feeder.

11. In a cement plant for producing cement clinker from cement raw meal by preheating the raw meal in a heat-exchanger system receiving heated gases from a rotary kiln off-gas line and from a clinker cooler off gas line, each of said off gas lines having a point of entry for raw meal, and burning the preheated raw meal to cement clinker in the rotary kiln, said heat exchanger system comprising:

a hollow impingement gate (19) integrated in one of said off-gas lines below said point of entry for raw meal in said one off-gas line, whereby said raw meal delivered to said one off gas line is distributed by impingement with said hollow gate (19), said hollow impingement gate (19) having a coolant inlet opening (41), at least one coolant discharge opening (42,43), and at least one web (39, 40) within said hollow gate (19) for distributing coolant flow through said hollow gate (19).

12. The cement plant of claim 11 wherein said one web (39,40) is disposed transverse to the plane of said gate (19) and diverts the coolant admitted via said coolant inlet opening (41) in route to at least one coolant discharge opening (42, 43).

13. The cement plant of claim 11 wherein at least one of said coolant discharge openings (42,43) and said coolant inlet opening (41) are located in an end face of said gate (19).

* * * * *